US005887974A

United States Patent [19]

Pozniak et al.

[11] Patent Number: 5,887,974

[45] Date of Patent: Mar. 30, 1999

[54] SLURRY MIXING APPARATUS AND METHOD

[75] Inventors: Peter M. Pozniak, San Jose; Benjamin R. Roberts, Los Altos; Duy Khanh Trang, San Jose, all of Calif.

[73] Assignee: The BOC Group, Inc., New Providence, N.J.

[21] Appl. No.: 978,887

[22] Filed: Nov. 26, 1997

[51] Int. Cl.[6] ..... B01F 15/02

[52] U.S. Cl. ..... 366/136; 366/160.3

[58] Field of Search ..... 366/134, 136, 366/137, 138, 159.1, 160.1, 160.2, 160.3, 162.1, 167.1, 181.8, 182.2

[56] References Cited

U.S. PATENT DOCUMENTS

| | | | |
|---|---|---|---|
| 2,135,261 | 11/1938 | Rosmait | 366/136 |
| 3,180,350 | 4/1965 | Rill, Jr. et al. | 366/160.3 |
| 4,057,223 | 11/1977 | Rosenberger | 366/136 |
| 4,319,848 | 3/1982 | Lambertini et al. | 366/160.3 |
| 4,482,704 | 11/1984 | Luetzelschwab | 366/137 |
| 4,664,528 | 5/1987 | Rodgers et al. | 366/137 |
| 4,823,987 | 4/1989 | Switall | 366/137 |
| 4,863,277 | 9/1989 | Neal et al. | 366/137 |
| 5,372,421 | 12/1994 | Pardikes | 366/137 |
| 5,407,526 | 4/1995 | Danielson et al. . | |
| 5,470,150 | 11/1995 | Pardikes | 366/137 |
| 5,478,435 | 12/1995 | Murphy et al. . | |
| 5,522,660 | 6/1996 | O'Dougherty et al. | 366/136 |
| 5,590,960 | 1/1997 | Clinton et al. | 366/136 |

FOREIGN PATENT DOCUMENTS

WO82/03023 9/1982 WIPO .

*Primary Examiner*—Charles E. Cooley
*Attorney, Agent, or Firm*—David M. Rosenblum; Salvatore P. Pace

[57] ABSTRACT

An apparatus and method for producing a slurry from a slurry concentrate in which streams of slurry concentrate, de-ionized water and oxidizer are pumped to form three pumped streams that are brought together to form a mixture. Homogeneity is promoted within the mixture by such devices as a static mixer and an in-line mixer of special design. The resultant homogenous stream is then pumped to dispense pressure by a dispense pump to produce a dispense stream. Part of the dispense stream, preferably about fifty percent, is recycled back to a junction at which the pumped streams join to further promote homogeneity of the slurry. For such purpose a flow network is connected to an outlet pump and such flow network is branched so as to have a dispense leg from which the dispense stream issues and a recycle leg connected to the junction for recirculating the recycle stream.

9 Claims, 1 Drawing Sheet

SLURRY MIXING APPARATUS AND METHOD

BACKGROUND OF THE INVENTION

The present invention provides an apparatus and method for producing a slurry from a slurry concentrate in which the slurry concentrate, de-ionized water and an oxidizer are pumped into a junction to produce the slurry. More particularly, the present invention relates to such an apparatus and method in which the homogeneity of the slurry is enhanced by passing the slurry through a mixing device and recirculating part of the finished slurry back to the junction.

Slurries are used in a variety of surface treatment techniques. An important surface treatment, used in the manufacture of semiconductor devices, is chemical mechanical polishing or planarization. Typically, slurries used in such surface treatment comprise potassium hydroxide, silicon oxide, an oxidizer such as hydrogen peroxide, and a diluent such as de-ionized water. Ferric nitrate or chloride might also be present. The oxidizer contained within the slurry acts on the surface to be treated and the abrasive particles sweep the surface layer away. Slurries are often shipped to a site as a slurry concentrate that contains, for instance, the potassium hydroxide and silicon dioxide. The diluent and oxidizer are then added to the concentrate at the site or in some instances at the tool itself.

There are however, many difficulties involved in the mixing of the slurry and the handling of the finished slurry, once mixed. One major problem is that the slurry has a very limited pot life and as such, there exists only a limited amount of time to use the slurry after having been mixed. Additionally, slurries such as those used in the semiconductor industry do not remain homogenous upon being subjected to shear forces. For instance, shear induced in the slurry due to sharp pipe bends will produce agglomeration which will destroy the usefulness of the slurry in the semiconductor manufacturing process.

Because of such problems, slurry delivery and mixing systems have been proposed in which the slurry is mixed on site from the slurry concentrate. An example of such a system is disclosed in U.S. Pat. No. 5,407,526. In this patent, the slurry concentrate and oxidant are pumped into a mixing chamber where they are mixed to form the finished slurry. The slurry is then immediately deposited onto the semiconductor so that it can be worked by the polishing tool. Another slurry mixing system is disclosed in U.S. Pat. No. 5,478,435 in which slurries are pumped directly onto a polishing pad of a chemical mechanical planarization tool.

In each of the foregoing patents, the mixing of the slurry from the slurry concentrate can only occur when the polishing tool is in operation. As will be discussed, the present invention provides an apparatus and method in which the slurry is mixed at a location that is remote from the polishing tool to allow for distribution of the slurry to several tools, each of which do not have to be operating. Furthermore, the present invention allows for greater control over the consistency and makeup of the slurry than is possible in either of the foregoing patents.

SUMMARY OF THE INVENTION

The present invention provides an apparatus for producing a slurry from a slurry concentrate. The apparatus comprises first, second, and third inlet pumps for pumping the slurry concentrate, de-ionized water, and an oxidizer, respectively. A junction is connected to the first, second, and third pumps so that the slurry concentrate, de-ionized water, and the oxidizer are brought into contact with one another to form a mixture. At least one mixing devise is connected to the junction to promote homogeneity of the mixture and thereby to form the slurry. An outlet pump is connected to the at least one mixing device to pump the slurry from the at least one mixing devise. A flow network is connected to the outlet pump. The flow network has a dispense leg and a recycle leg for dividing a stream of the slurry into a dispense stream and a recycle stream. The recycle leg is connected to the junction for feeding the recycle stream to the mixture. The recycle leg has a pressure reduction valve for reducing the dispense pressure to a pressure imparted to the slurry concentrate, de-ionized water, and the oxidizer by the first, second, and third pumps.

In another aspect, the present invention provides a method for producing a slurry from a slurry concentrate. In accordance with the method, the slurry concentrate, de-ionized water, and oxidizer are pumped to form three pumped streams having a pressure imparted to them by the pumping. The three pumped streams are brought into contact with one another and a recycle stream to form a mixture. Homogeneity is promoted within the mixture to form the slurry. The slurry is pumped by an outlet pump to a dispense pressure and is then divided into a dispense stream and the recycle stream. The dispense pressure of the recycle stream is then reduced to the pressure that was obtained prior to combining the recycle stream with the three pumped streams.

As can be appreciated from the above description, although the slurry is formed on-site and upon demand, the polishing or other equipment utilizing the slurry does not have to be in operation during the mixing of the slurry. Moreover, there exists a greater degree of control over the consistency of the slurry due to promotion of homogeneity with mixing devices as well as the recycle of finished slurry.

BRIEF DESCRIPTION OF THE DRAWINGS

While the specification concludes with claims distinctly pointing out the subject matter that Applicants regard a their invention, it is believed the invention will be better understood when taken in connection with the accompanying drawings in which:

DETAILED DESCRIPTION

Figure 1:
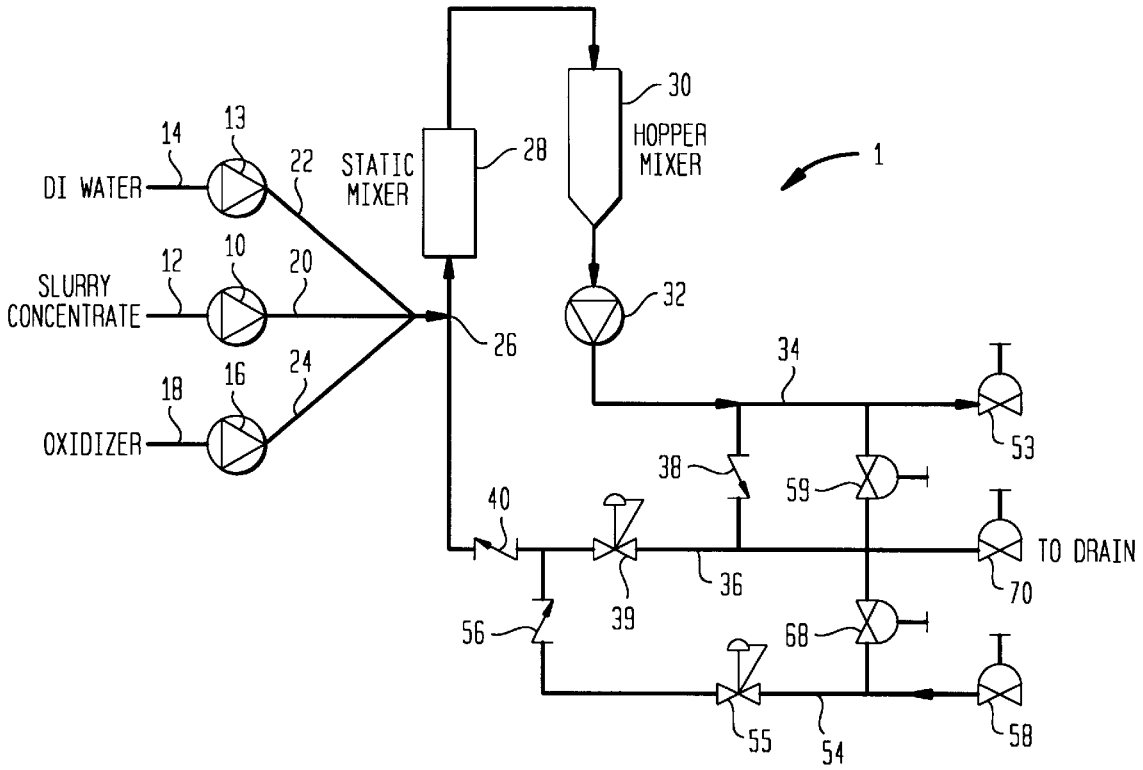
FIG. 1. Is a schematic view of an apparatus for carrying out a method in accordance with the present invention.

With reference to FIG. 1., an apparatus 1 for producing a slurry in accordance with the present invention as illustrated. Apparatus 1 can be a stand-alone unit or used in conjunction with a known distribution apparatus to feed slurry under pressure to one or more points of use.

A first pump 10 is provided for pumping a stream 12 of a slurry concentrate. A second pump 13 is provided for pumping a stream 14 of de-ionized water and a third pump 16 is provided for pumping a stream 18 of oxidizer. First, second, and third pumps 10, 13, and 16 are preferably peristaltic pumps. Furthermore, it is preferable that first, second and third pumps 10, 13 and 16 are variable speed pumps so that the ratio of the constituents to be pumped can be adjusted. It is understood that other types of adjustment are possible, for instance, a fixed adjustment could be effected by providing pumps of differing capacities. It is to be noted that in any embodiment, the pipes carrying streams 20, 22, and 24 should be of equal length so that the desired flows can easily be adjusted over time without causing temporal shifts in the mix ratios.

The three pumped streams, 20, 22 and 24 are fed into a junction 26. As can appreciated, since first, second, and third, pumps 10, 13, and 16 are operating at different speeds and there is some flow pulsation produced by each pump, a series of regions are produced within the stream leaving junction 26 that are richer in one component than another component. As will be discussed, a recycle stream which is made up of the finished slurry also feeds junction 26.

The slurry then passes through a known static mixer 28. Static mixer 28 is packed to drive mixed slurry outward and thus promote homogeneity in a direction radial to the direction of flow. The now radially, uniform slurry passes into a hopper mixer 30 which promotes homogeneity of the slurry stream in the direction of flow. An output pump 32 is connected to mixer 30 to pump the slurry to a delivery pressure. An embodiment of the present invention is possible that does not incorporate static mixer 28. In such embodiment, slight changes in slurry makeup, taken in a radial direction to the slurry flow would be tolerated.

The slurry then passes to a flow network connected to outlet pump 32. The flow network has a dispense leg 34 and a recycle leg 36. Preferably, the flow network should be designed, through appropriate pipe sizing, such that about 50% of the slurry entering dispense leg 34 recycles within recycle leg 36. Higher or lower recycle rates are of course possible depending upon the intended slurry composition. A check valve 38 is provided to prevent the recycle stream from flowing back towards the dispense leg 34. A pressure regulating valve 39 is provided to reduce the pressure of the recycle stream from the dispense pressure to the pressure imparted by first, second, and third pumps 10, 13, and 16. As illustrated, a recycle leg 36 connected to junction 26 can be joined by a return leg 38. A check valve 40 may be provided within the recycle leg 36 to prevent back flow.

Figure 2:
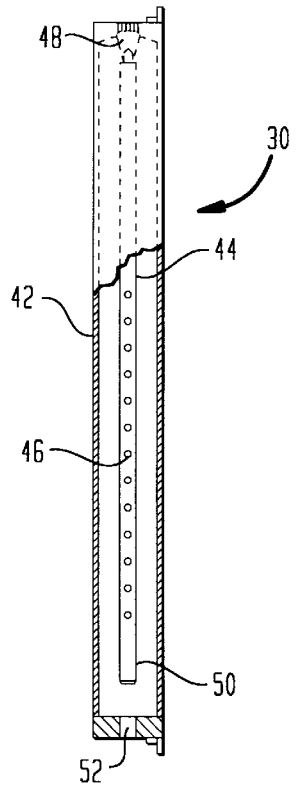
FIG. 2. Is a sectional view of a mixing device used in FIG. 1.

With additional reference to FIG. 2, hopper mixer 30 is provided with a hopper 42 and a coaxial pipe 44 located within hopper 42. Coaxial pipe 44 is provided with openings 46 in sets of four openings preferably spaced 90 degrees apart so that the slurry escapes from pipe 44 in four orthogonal directions into hopper 42. Pipe 44 is open at one end 48 to receive slurry and is closed at end 50. The slurry thus mixes with itself in a longitudinal direction within hopper 42 and thus, parallel relative to its direction of flow. The slurry is discharged from a bottom opening 52 located in the bottom of hopper 42. Other inline mixing devises are possible.

The slurry passes out of dispense leg 34 and through a valve 53 that can be used to isolate the slurry tool from the flow network. After the tool, the slurry returns through return leg 54. The pressure of such return is reduced by use of a pressure regulation valve 55. A check valve 58 can be provided to prevent back flow. Returning slurry (or more appropriately termed, unused slurry) joins return leg 38 and is thus also fed to junction 26.

Return leg 38 can be isolated from the slurry tool by a valve 58. If both valves 53 and 58 are shut, valves 59 and 68 can be opened to allow the system to be flushed with deionized water for cleaning purposes. Therefore during operation of apparatus 1, valves 53 and 58 are set in an open position and valves 59 and 68 are set in a closed position. An isolation valve 70 can be provided to isolate the drain from the flow network during the cleaning thereof.

While the invention has been described with reference to a preferred embodiment, as will occur to those skilled in the art, numerous changes, additions and omissions may be made without departing from the spirit and scope of the present invention.

We claim:

1. An apparatus for producing a slurry from a slurry concentrate, said apparatus comprising:

first, second, and third inlet pumps for pumping said slurry concentrate, de-ionized water, and an oxidizer, respectively;

a flow network having a dispense leg and a recycle leg for dividing a stream of said slurry into a dispense stream and said recycle stream, respectively;

a junction connected to said first, second, and third pumps and said recycle leg of said flow network so that said slurry concentrate, said de-ionized water, said oxidizer, and said recycle stream are brought into contact with one another to form a mixture;

at least one mixing device connected to said junction to promote homogeneity of said mixture and thereby to form said slurry;

an outlet pump connected to said at least one mixing device to pump said slurry from said at least one mixing device;

said flow network connected to said outlet pump; and said recycle leg having a pressure reduction valve for reducing said dispense pressure to a pressure imparted to said slurry concentrate, said de-ionized water, and said oxidizer by said first, second, and third inlet pumps.

2. The apparatus of claim 1, wherein said at least one mixing device comprises: a hopper having a vertically oriented pipe having perforations from which said mixture escapes into said hopper;

said hopper having a bottom outlet connected to said outlet pump.

3. The apparatus of claim 2, wherein said at least one mixing device further comprises a static mixer.

4. The apparatus of claim 1 or claim 3 wherein said flow network further has a return leg connected to said junction for feeding unused slurry back to said at least one mixing device, said return leg having another pressure regulating valve for reducing said dispense pressure back to said pressure imparted to said slurry concentrate, said de-ionized water, said oxidizer by said first, second, and third inlet pumps.

5. The apparatus of claim 1, wherein said pumps are variable speed pumps.

6. A method for producing a slurry from a slurry concentrate, said method comprising:

pumping said slurry concentrate, de-ionized water, and an oxidizer to form three pumped streams having a pressure imparted by said pumping;

bringing said three pumped streams into contact with one another and a recycle stream to form a mixture;

promoting homogeneity within said mixture to form said slurry;

pumping said slurry to a dispense pressure;

dividing said slurry into a dispense stream and said recycle stream; and reducing the dispense pressure of said recycle stream to said pressure prior to combining said recycle stream with said three pumped streams.

7. The method of claim 6, wherein homogeneity is promoted by introducing said mixture into a static mixer feeding a vertically oriented pipe contained with a hopper, said pipe having perforations from which said mixture escapes into said hopper.

8. The method of claim 6, further comprising introducing unused slurry into said mixture.

9. The method of claim 6, wherein pumping speed of said pumps is adjusted to control proportions of said slurry concentrate, de-ionized water, and oxidizer.

* * * * *